US006092579A

United States Patent [19]

Bradatsch et al.

[11] Patent Number: 6,092,579

[45] Date of Patent: Jul. 25, 2000

[54] MACHINE FOR THE PRODUCTION OF AN AT LEAST SINGLE-FACE LINED WEB OF CORRUGATED BOARD

[75] Inventors: Edmund Bradatsch, Schirmitz; Hermann-Josef Mensing, Weiherhammer; Gustav Alfons Gnan, Vilseck; Wilhelm Graff, Düren, all of Germany

[73] Assignee: BHS Corrugated Maschinen-und Anlagenbau GmbH, Weiherhammer, Germany

[21] Appl. No.: 09/195,208

[22] Filed: Nov. 18, 1998

[30] Foreign Application Priority Data

Nov. 19, 1997 [DE] Germany ..... 197 51 162

[51] Int. Cl.[7] ..... B31F 1/28

[52] U.S. Cl. ..... 156/472; 156/470; 139/383 A

[58] Field of Search ..... 162/348, 900, 162/904; 34/111, 116, 117, 120, 123; 100/118, 151, 153; 156/470, 471, 472, 473, 583.5; 474/266; 442/6, 203, 204, 208; 139/420 R, 425 R, 428 A, 416, 384 R, 383 A; 245/2

[56] References Cited

U.S. PATENT DOCUMENTS

| | | | |
|---|---|---|---|
| 1,814,598 | 7/1931 | Herrmann | 139/425 R |
| 2,041,137 | 5/1936 | Koester | 139/383 A |
| 2,731,046 | 1/1956 | Bachner | 139/420 R |
| 2,817,371 | 12/1957 | Bussiere | 139/383 R |
| 3,067,779 | 12/1962 | Draper, Jr. | 139/383 A |
| 4,187,618 | 2/1980 | Diehl | 139/383 A |
| 4,287,017 | 9/1981 | Lopata et al. | 156/583.5 |
| 4,945,952 | 8/1990 | Vohringer | 139/425 A |
| 5,370,797 | 12/1994 | Cagle | 245/2 |
| 5,562,968 | 10/1996 | Fry | 139/383 A |
| 5,632,850 | 5/1997 | Knorr et al. . | |

FOREIGN PATENT DOCUMENTS 2305675 4/1997 United Kingdom .

*Primary Examiner*—Michael W. Ball
*Assistant Examiner*—Barbara Musser
*Attorney, Agent, or Firm*—Browdy and Neimark

[57] ABSTRACT

A machine for the production of a single-face lined web of corrugated board comprises a pressing device for pressing a liner web on a paper web provided with a corrugation. This pressing device comprises a vapor permeable pressing belt which consists of a fabric of metal with warp threads and weft threads. The warp threads are provided in groups of three warp threads at a time, the distance of two neighboring groups of warp threads being smaller than the width of each group of warp threads. Preferably, the material of the weft threads is softer than the material of the warp threads, the weft threads having notches, in each of which a warp thread is disposed.

6 Claims, 3 Drawing Sheets

FIG. 2
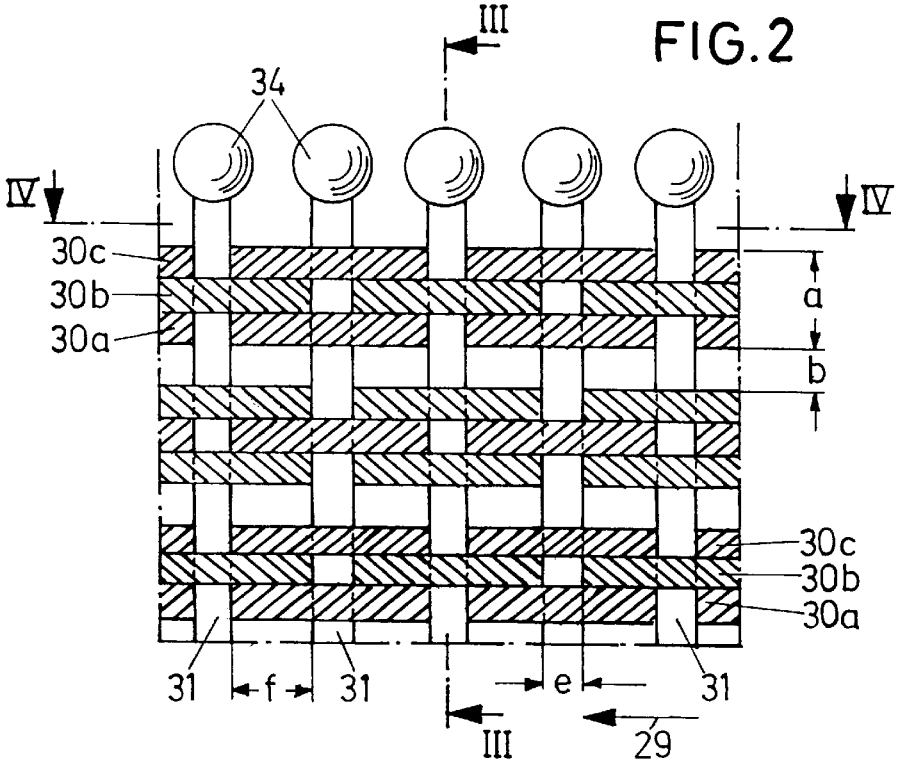
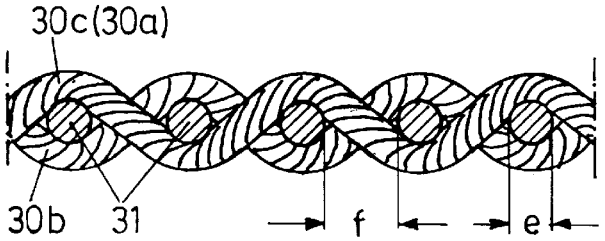
FIG. 4
FIG. 3
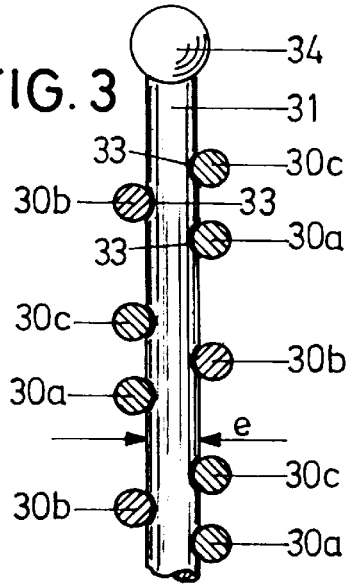
FIG. 5
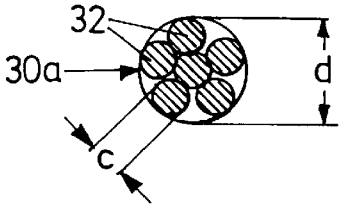

MACHINE FOR THE PRODUCTION OF AN AT LEAST SINGLE-FACE LINED WEB OF CORRUGATED BOARD

BACKGROUND OF THE INVENTION

1. Field of the Invention

The invention relates to a machine for the production of an at least single-face lined web of corrugated board, comprising two fluted rolls for producing a corrugation on a paper web; a gluing device for applying glue to the peaks of the corrugations of the corrugated paper web; a pressing device for pressing a liner web on the glue on the peaks of the corrugated paper web which rests on one of the fluted rolls along a pressing zone; the pressing device comprising a continuous pressing belt which is guided along a deflection pulley and another pulley and which is pressed against the fluted roll over the pressing zone and which consists of a fabric of metal having warp threads and weft threads.

2. Background Art

A machine of the generic type is known from GB 2 305 675 A. The fundamental problem residing in the use of pressing belts of metal fabric consists in that, in operation, the weft threads—starting from the edges towards the middle—sag in the forward direction, i.e. in the conveying direction, which reduces the belt width. The joint between the ends of the metal fabric formed into a continuous pressing belt is bent in the same way and, in operation, subjected to work done on bending and on torsion, which negatively affects the service life of the pressing belt.

SUMMARY OF THE INVENTION

It is an object of the invention to embody the pressing belt of the machine of the species such that its service life is distinctly increased.

According to the invention, the object is attained by the features which consist in that the warp threads are provided to form groups of three warp threads at a time with two outer warp threads and one central warp thread, the distance of two neighboring groups of warp threads being smaller than the width of each group of warp threads. The measures according to the invention help obtain symmetric clamping of the weft threads between the groups of warp threads, the described sagging effect of the weft threads being simultaneously precluded by the small distance between adjoining groups of warp threads.

Further features, advantages and details of the invention will become apparent from the ensuing description of an exemplary embodiment of the invention taken in conjunction with the drawing.

BRIEF DESCRIPTION OF THE DRAWING

FIG. 2 is a plan view of a partial section from a pressing belt;

FIG. 3 is a cross sectional view of the pressing belt on the section line III—III of FIG. 2;

FIG. 4 is a lengthwise section through the pressing belt on the section line IV—IV of FIG. 2;

FIG. 5 is a cross-sectional view of a warp thread; and

DESCRIPTION OF THE PREFERRED EMBODIMENT

Figure 1:
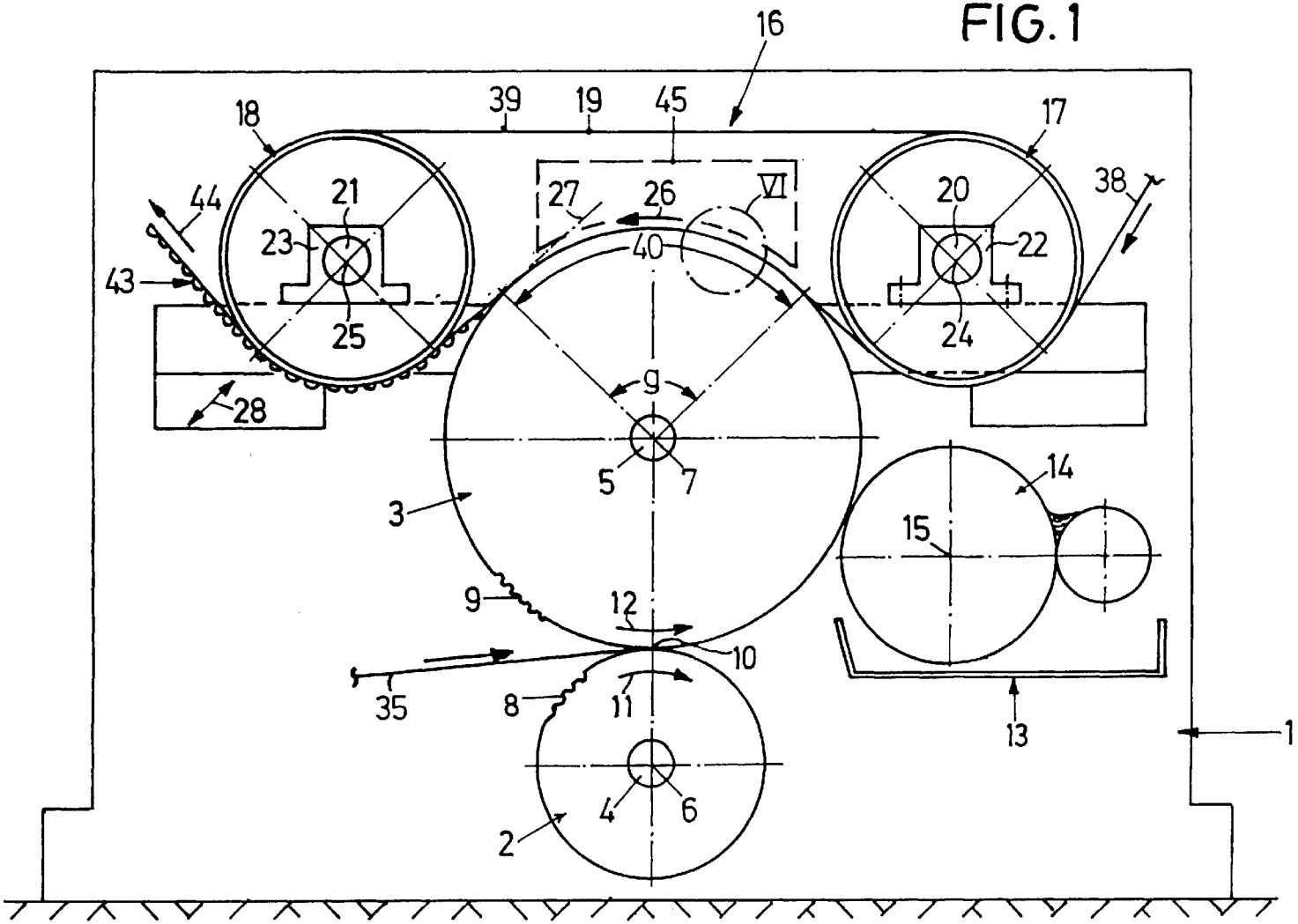
FIG. 1 is a vertical illustration of a machine for the manufacture of a single-face lined web of corrugated paper.

On a machine frame 1, a lower fluted roll 2 and an upper fluted roll 3 are supported for rotation by means of shafts 4, 5. They have axes 6, 7 parallel to each other. On their cylinder faces, they are provided with flutings 8, 9, which extend in parallel to the axes 6, 7 and which mesh in the contact area 10 of the two fluted rolls 2, 3. One of the fluted rolls 2, 3, usually the upper fluted roll 3, is driven in the direction of rotation 12, whereas the other fluted roll, usually the lower fluted roll 2, is driven by the other fluted roll 3 in the direction of rotation 11. A gluing device 13 is disposed on the machine frame 1 downstream of the contact area 10 seen in the direction of rotation 11 or 12; this gluing device 13 has a glue spreading roll 14 to be advanced toward the fluting 9 of the upper fluted roll 3. The spreading roll 14 is rotatable about an axis 15.

Provided in the upper part of the upper fluted roll is a pressing device 16 which comprises a deflection pulley 17, a tensioning pulley 18 and a pressing belt 19. By means of shaft journals 20 and 21, the deflection pulley 17 and the tensioning pulley IS are run in bearings 22 and 23 of the machine frame 1 for free rotation about an axis 24 and 25, respectively, i.e. they are not driven. All the axes 6, 7, 15, 24, 25 are parallel to each other. Designs of the tensioning pulley 18 are generally known, for instance from U.S. Pat. No. 5,632,850. Tensioning of the pressing belt 19 takes place by displacement of the tensioning pulley 18 parallel to the run-off tangent in the direction 28.

As seen in FIG. 1, the pressing belt 19 bears against the fluting 9 of the upper fluted roll 3 by an angle g of belt contact of approximately 90°, circulating in the same direction of rotation as the upper fluted roll 3 in accordance with the arrow 26. The pressing belt 19 runs off the upper fluted roll 3, corresponding to the run-off tangent 27 which is identical with the run-on tangent of the pressing belt 19 on to the tensioning pulley 18.

The pressing belt 19 is a fine-meshed screen belt of tensile strength namely a fabric, as seen in detail in FIGS. 2 to 5. It comprises warp threads 30 extending in its longitudinal direction 29 which corresponds to the arrow 26, and weft threads 31 running at right angles thereto. The warp threads 30 are provided as groups of three warp threads 30*a*, 30*b*, 30*c* at a time, these groups of warp threads 30*a*, 30*b*, 30*c* having a width a which is greater than the distance b between adjoining groups of warp threads. The two outer warp threads 30*a*, 30*c* of each group of warp threads run in the same direction, i.e. they are each guided along the same side of a weft thread 31, whereas the central warp thread 30*b* is guided oppositely, as seen in particular in FIGS. 2 to 4. Symmetric clamping of the respective weft thread (31) if obtained due to the fact that the three warp threads 30*a*, 30*b*, 30*c* per group of warp threads 30*a*, 30*b*, 30*c* are provided and guided in this way.

This course of the warp threads 30*a* to 30*c* alternates from one group of warp threads 30*a* to 30*c* to the neighboring pair, as seen in particular in FIGS. 2 and 3. With reference to the plan view of FIG. 2, this means that whenever the central warp thread 30*b* of FIG. 2 runs over a weft thread 31, the central warp thread 30*b* of the neighboring group of warp threads, again with reference to the plan view of FIG. 2, will be guided past the weft thread 31 from below. The same applies reversely to the two outer warp threads 30*a* and 30*c*, of identical course, of each group of warp threads.

As seen in FIG. 5, each warp thread 30*a* to 30*c* comprises six strands 32 which are intertwisted as roughly outlined in FIGS. 2 and 4. The diameter c of each strand 32 is in the range of 0.2 mm. The diameter c of the strands 32 may also be less than 0.2 mm, namely in range of 0.15 to 0.2 mm, for the purpose of wear reduction. Consequently, the diameter d of each warp thread 30*a* to 30*c* is in the range of 0.6 mm. The strands 32 each consist of steel wire. Because of their being intertwisted, the individual warp threads 30*a* to 30*c* have a high tensile strength on the one hand and are very flexible on the other. $1.2d \geqq a \geqq 0.3d$ applies to the ratio that the distance b between the groups of warp threads 30*a* to 30*c* bears to the diameter d of the individual warp threads 30*a,* 30*b,* 30*c.*

The weft threads 31 consist of a material which is softer than the material of the warp threads 30*a* to 30*c* so that the warp threads 30*a* to 30*c* dig into the weft threads 31, forming slight notches 33, so that any displacement of the warp threads 30*a* to 30*c* in the direction of the weft threads 31 is additionally precluded. High alloy chrome nickel steels can be used as a material for the weft threads 31 and the warp threads 30*a* to 30*c,* which are of identical alloying composition, so that stress corrosion is precluded. The difference in strength is obtained in known manner by the kind of wire drawing and the accompanying working jobs which are known in practice. The free ends 34 of the weft threads 31 have the shape of a spherical cap, i.e. they are rounded off so as to preclude any risk of injury.

The weft threads 31 consist of rod-type wires, the diameter e of which is in the range of 1.0 mm. The distance f between neighboring weft threads 31 is in the range of 1.0 to 1.5 mm and preferably in the range of 1.1 to 1.2 mm.

The pressing belt 19 is made from a finite belt of metal fabric, the ends of which are joined together in the vicinity of the weft thread 31 in customary manner according to the prior art, for instance by a soldered joint. Alternatively loops can be welded on the end of the warp threads, a bar being pushed through these loops.

The function of the machine is as follows:

A paper web 35 arrives as the area of contact 10 between the lower and the upper fluted roll 2, 3 and is provided with a corrugation 36 by the flutings 8) 9. The peaks 37 of the respective corrugation 36 are provided with glue in the gluing device 13. The rest of the corrugated paper web 35 is not glued. Via the deflection pulley 17, a liner web 38 is supplied, likewise consisting of paper and having the same width as the paper web 35. This liner web 38 is led in on the outside 39 of the pressing belt 19 and, in the pressing zone 40 of the pressing belt 19 defined by the angle of belt contact g, it is pressed against the peaks 37 of the corrugated paper web 35, located on the fluting 9 of the upper fluted roll 3, and united with the paper web 35. In this case, the outside 39 of the pressing belt 19 presses the liner web 38 against the corrugated paper web 35.

Figure 6:
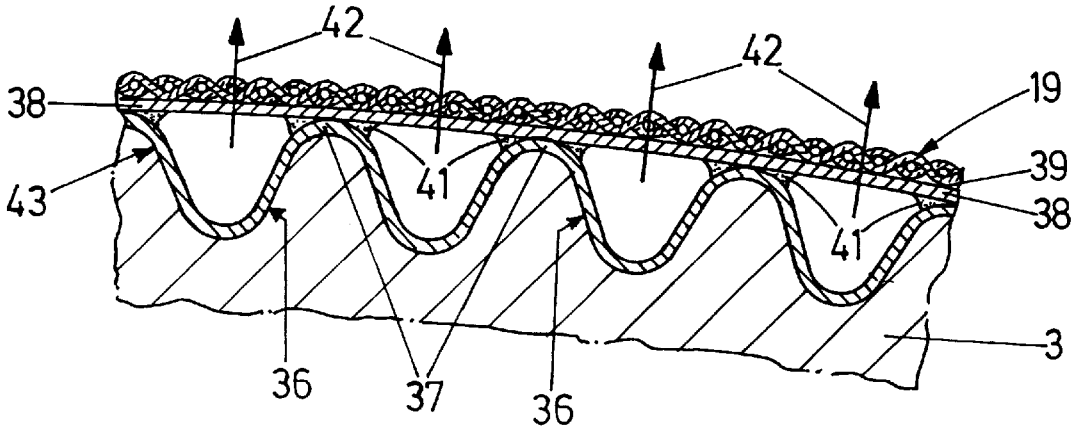
FIG. 6 is a partial sectional illustration corresponding to the detail VI of FIG. 1 and on a strongly enlarged scale as opposed to FIG. 1.

Since the tipper fluted roll 3 is heated in customary manner, for example to approximately 170° C., the water contained in the glue 41 on the peaks 37 of the corrugations 36 evaporates, escaping at least partially through the liner web 38 and the sieve-type, woven pressing belt 19, as is roughly outlined by the arrows of flow direction in FIG. 6.

Together with the pressing belt 19, the finished glued corrugated board web 43, single-face lined by a liner web 38, runs off the upper fluted roll 3 in the direction of the run-off tangent 27 and is guided by the pressing belt 19 partially around the tensioning pulley 18, from where it is fed to a take-up roller in the draw-off direction 44.

Heating the paper webs 35, 38 need not necessarily take place via the fluted roll 3. Alternatively or optionally, this may also be effected by a heater 45 disposed within the pressing belt 19 between the deflection pulley 17 and the tensioning pulley 18 and roughly outlined by a dashed line in FIG. 1.

What is claimed is:

1. A machine for the production of at least a single-face lined web of corrugated board (43), comprising:

two fluted rolls (2, 3) for producing a corrugation (36) on a paper web (35), a gluing device (13) for applying glue (41) to the peaks (37) of the corrugations (36) of the corrugated paper web (35), a pressing device (16) for pressing a liner web (38) on the glue (41) on the peaks (37) of the corrugated paper web (35) which rests on one of the fluted rolls (3) along a pressing zone (40), the pressing device (16) comprising a continuous pressing belt (19) which is guided along a deflection pulley (17) and another pulley (18) and which is pressed against the fluted roll (3) over the pressing zone (40) and which consists of a fabric of metal having warp threads (30*a,* 30*b,* 30*c*) and weft threads (31), wherein the warp threads (30*a,* 30*b,* 30*c*) are provided to form groups of three warp threads (30*a,* 30*b,* 30*c*) at a time with two outer warp threads (30*a,* 30*c*) and one central warp thread (30*b*), the distance b between two neighboring groups of warp threads (30*a,* 30*b,* 30*c*) being smaller than the width a of each group of warp threads (30*a,* 30*b,* 3*c*);

wherein the weft threads (31) are of the same diameter and formed of a rod-type wire;

wherein the weft threads (31) and the warp threads (30*a,* 30*b,* 30*c*) are of substantially the same high chrome nickel steel alloy, and the weft threads (31) are softer than the warp threads (30*a,* 30*b,* 30*c*); and wherein the weft threads (31) have notches (33), in each of which a warp thread (30*a,* 30*b,* 30*c*) is disposed.

2. A machine according to claim 1, wherein $1.2d \geqq b \geqq 0.3d$ applies to the ratio that the distance b between two neighboring groups of warp threads (30*a,* 30*b,* 30*c*) bears to the diameter d of the individual warp threads (30*a,* 30*b,* 30*c*).

3. A machine according to claim 1, wherein the diameter e of the weft threads (31) exceeds the diameter d of the warp threads (30*a,* 30*b,* 30*c*).

4. A machine according to claim 1, wherein the warp threads (30*a,* 30*b,* 30*c*) consist of intertwisted strands (32).

5. A machine according to claim 1, wherein the two outer warp threads (30*a,* 30*c*) are guided to take the same course over the weft threads (31) and wherein the central warp thread (30*b*) is guided oppositely to the two outer warp threads (30*a,* 30*c*).

6. A machine according to claim 5, wherein the outer warp threads (30*a,* 30*b,* 30*c*) of each individual group of warp threads (30*a,* 30*b,* 30*c*) are guided over the same weft thread (31) on a course that is opposite to that of the outer warp threads in the two neighboring groups of warp threads (30*a,* 30*b,* 30*c*).

* * * * *